United States Patent [19]

Martin et al.

[11] Patent Number: 4,548,115

[45] Date of Patent: Oct. 22, 1985

[54] POSITIONING APPARATUS

[75] Inventors: John F. Martin, Essex; Donald E. Ripley, Peabody, both of Mass.

[73] Assignee: USM Corporation, Farmington, Conn.

[21] Appl. No.: 487,231

[22] Filed: Apr. 28, 1983

[51] Int. Cl.[4] ..... B26D 7/02

[52] U.S. Cl. ..... 83/409; 83/422; 269/73; 414/749

[58] Field of Search ..... 83/277, 71, 412, 422, 83/409; 269/73, 296; 198/345, 346, 740, 488, 487, 456; 414/749, 750

[56] References Cited

U.S. PATENT DOCUMENTS

| | | | |
|---|---|---|---|
| 3,449,991 | 6/1969 | Daniels | 83/277 |
| 3,563,123 | 2/1971 | Leibinger | 83/277 |
| 3,650,133 | 3/1972 | Bredow | 83/409 |
| 3,691,887 | 9/1972 | Roch | 83/277 |
| 3,701,297 | 10/1972 | Kovic | 83/409 |
| 3,717,061 | 2/1973 | Daniels | 83/409 |
| 4,165,667 | 8/1979 | Brolund et al. | 83/412 |

*Primary Examiner*—Frank T. Yost
*Assistant Examiner*—Hien H. Phan
*Attorney, Agent, or Firm*—William F. White

[57] ABSTRACT

Apparatus is disclosed for positioning a large, flexible workpiece relative to a high speed reciprocating tool. The apparatus comprises a frame and associated workpiece supports which move in a first direction. A workpiece holding assembly mounted to the frame moves the workpiece over the workpiece supports in a second direction transverse to the first direction of movement. The supports engage channels of a tool bed associated with the operative tool and are preferably beveled so as to prevent interference with the moving workpiece.

10 Claims, 3 Drawing Figures

POSITIONING APPARATUS

FIELD OF THE INVENTION

This invention relates to apparatus for positioning an article relative to an operative tool. In particular, this invention relates to the positioning of an article relative to a reciprocating punch which is cutting a pattern in the article.

BACKGROUND OF THE INVENTION

The need to position an article rapidly and accurately with respect to an operative tool is a basic requirement in today's automated machinery. This requirement becomes particularly challenging when the article must be incrementally moved only when the operative tool is not engaging the article. As the size of the article increases, the problem of achieving a desired accuracy within the finite period of time allowed for positioning the article becomes even more difficult. This is in part attributable to the inertia of a large article. Inaccuracies can also occur as a result of the article itself flexing as it is being quickly moved. This can be particularly problematical when the workpiece is being held at a considerable distance from the point of tool operation. In this regard, any bending or flexing of the workpiece will result in a substantial error at the point of tool operation.

OBJECTS OF THE INVENTION

It is an object of this invention to provide a positioning apparatus which rapidly and accurately positions relatively large, heavy and flexible pieces of work relative to an operative tool.

It is another object of this invention to provide a positioning apparatus which holds a relatively large piece of work in such a manner as to substantially eliminate the flexing of the workpiece.

It is still another object of the invention to provide a positioning apparatus which rapidly and accurately positions distant portions of a large piece of work so that the same may be operated on by a high speed reciprocating tool.

SUMMARY OF THE INVENTION

The above and other objects are achieved by providing a frame movable in a first direction relative to an operative tool. A workpiece holder is mounted for movement on the frame in a second direction transverse to the direction of movement of the frame. The workpiece holder includes an air actuated clamp which clamps the workpiece to be operated on by the tool. A plurality of supports extend outwardly from the movable frame in a manner which allows the workpiece to be supported in a predefined plane. The supports engage grooved areas within a support bed associated with the operative tool. The supports and support bed are tapered in such a manner as to minimize interference with exposed edges of the workpiece that move relative to the supports.

DESCRIPTION OF THE PREFERRED EMBODIMENT

Figure 1:
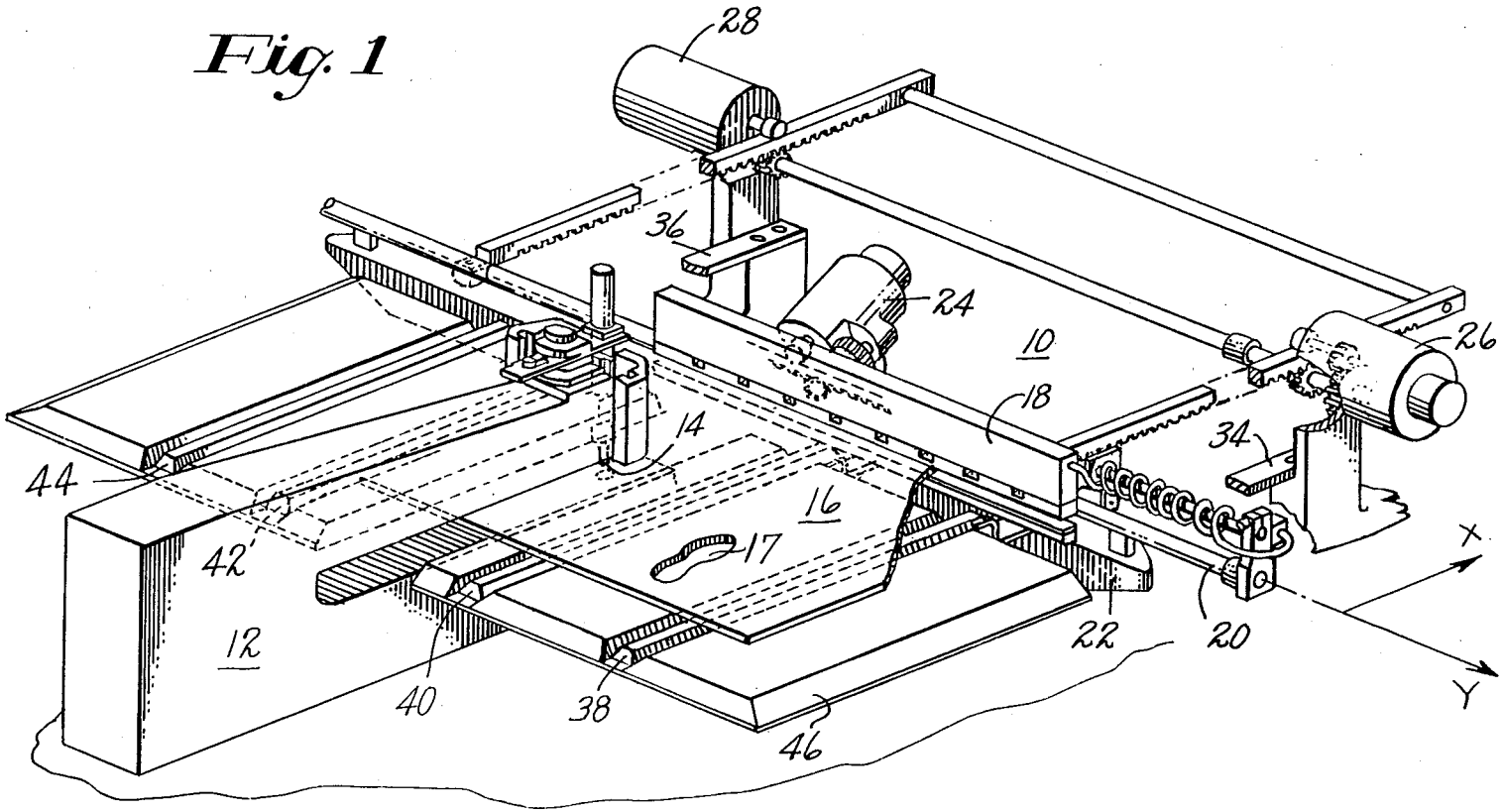
FIG. 1 illustrates the positioning apparatus relative to an operative tool.

Referring to FIG. 1, a positioning apparatus 10 is generally illustrated relative to a reciprocating operative tool 12. The reciprocating operative tool 12 illustrated in FIG. 1 is an automatic high speed punch having a reciprocating punch point 14 which engages a workpiece 16 positioned thereunder. The workpiece 16 is incrementally moved underneath the punch point 14 which cuts out a finished product. The finished product may be an outline of a shoe sole labeled 17. It is to be understood that the reciprocating operative tool 12 could also be an automated sewing machine or other reciprocating type of tool operating on an appropriate workpiece 16.

The workpiece 16 is held within an air actuated clamp mechanism 18 which is mounted for movement along a rod 20. The movement of the air actuated clamp 18 along the rod 20 will be arbitrarily defined as the Y-axis of movement. The air actuated clamp 18 is driven in the Y direction by a motor 24 in a manner which will be described hereinafter. The frame member 22 is driven in the X direction by a pair of motors 26 and 28 having pinion drives which engage gear racks 30 and 32. The frame 22 is mounted for movement on a pair of rail guides 34 and 36 so as to move in the X direction. The mounting of the frame 22 on the rail guides 34 and 36 as well as the specific motorized drives of motors 24, 26 and 28 are further discussed in U.S. Application Ser. No. 266,143, entitled, "Positioning Apparatus", filed on May 22, 1981 in the names of Herbert Johnson and Richard M. Elliott. It is to be understood that this positioning apparatus allows any portion of the workpiece to be registered underneath the punch point 14. This includes the far corners of the workpiece located opposite the clamped edge of the workpiece. This latter positioning of the workpiece is achieved when the frame 22 is pulled to an extreme rearward position by the motors 26 and 28.

Referring again to the frame 22, it is seen that four cantilevered supports labelled 38, 40, 42 and 44 extend outwardly from the frame. Each of the cantilevered supports slidably engage a respective groove or channel within a bed 46 associated with the chassis of the operative tool 12. The bed actually consists of two separate pieces mounted to either side of the tool chassis. The centerlines of the channels within these two separate pieces 46 are preferably spaced six and five-eights inches apart so as to accommodate the spaced cantilevered supports. The centerline of the channels for supports 40 and 42 are preferably spaced at a distance of three and five-sixteenths inches to either side of the punch point 14.

Figure 2:
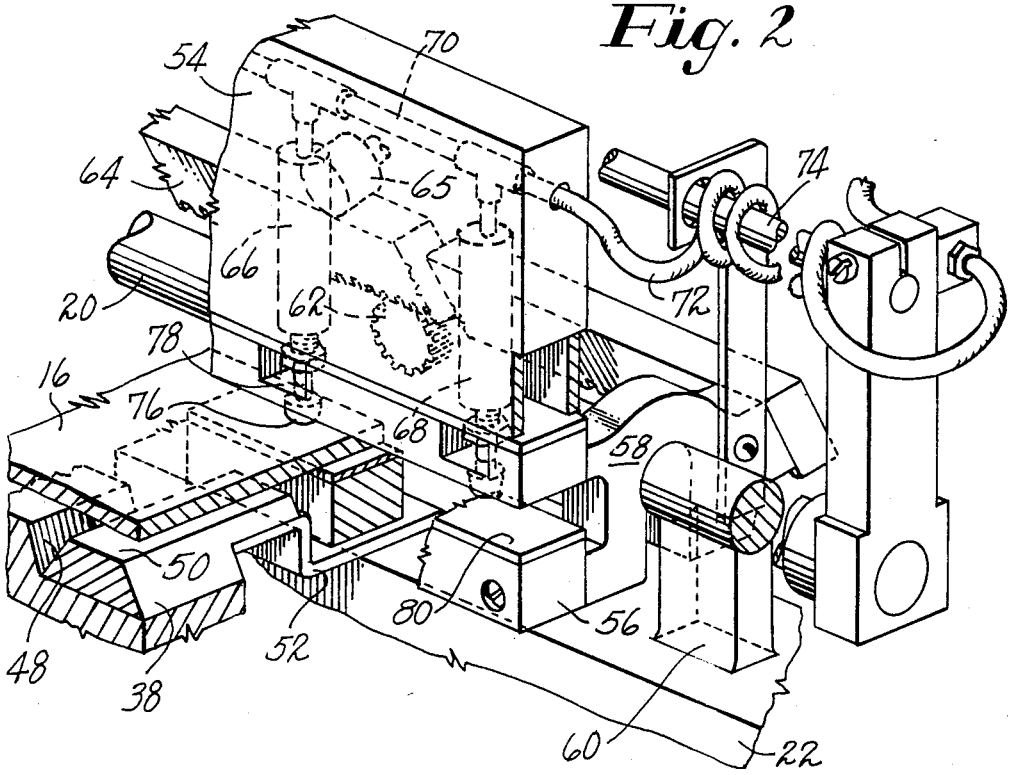
FIG. 2 is a detailed view of the positioning apparatus illustrating the air actuated clamp and the supports which extend outwardly from the movable frame of the positioning apparatus.
Figure 3:
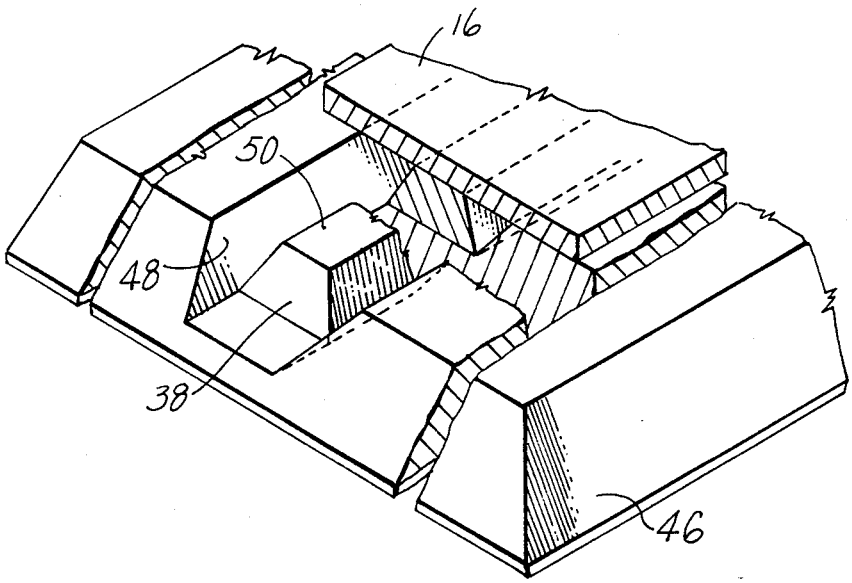
FIG. 3 illustrates the engagement of the supports with the bed associated with the operative tool.

Referring to FIGS. 2 and 3, the cantilevered support 38 is particularly illustrated relative to a channel 48 in the bed 46. The height of the support 38 relative to the depth of the channel 48 is such as to define a slightly higher support surface 50 for the workpiece 16. In this manner, the workpiece 16 is normally supported by the top surfaces of the four supports 38, 40, 42 and 44.

It is to be noted that the front and sides of the support 38 are preferably beveled at an angle of forty degrees from the horizontal top surface 50. The walls of the channel 48 as well as all edges of the two piece bed 46 are preferably beveled at an angle of thirty degrees from the top horizontal surface of the bed. This results in a beveled surface being encountered at all times by an edge of the workpiece 16. This beveling is particularly important for the supports 38 as well as the edges of the bed 46 which encounter a moving workpiece 16. In other words, an open, cut or punched edge of the workpiece moving in the Y-direction relative to the supports 38, 40, 42 and 44 or bed 46 will always encounter a sloped surface. Also the supports moving in the X-direction will always present a beveled front surface to an open, cut or punched edge of the workpiece which may or may not be moving in the Y-direction.

Referring now to FIG. 2, the cantilevered support 38 is seen to attach to the top of the frame 22 via an angular bracket 52. The bracket 52 is preferably secured by several self-locking machine screws engaging threaded holes in the support 38 and the frame 22. In this manner, each support is rigidly affixed to the frame 22. Each support preferably extends a minimum distance of nineteen and five-eights inches from the frame 22 so as to always engage a respective channel within the bed 46. This minimum distance must meet the criteria defined by the motors 26 and 28 moving the frame to an extreme rearward position.

The clamp 18 is seen to comprise a top portion 54 and a bottom portion 56. Both clamp portions are mounted to a collar 58 in FIG. 2. A similar collar to 58 appears at the other end of the clamp 18 which is not shown in FIG. 2. These collars serve to slidably mount the clamp 18 to the rod 20 which is in turn mounted to the frame 22 via a series of posts such as 60. In this regard, the collar 54 is configured so as to avoid interference with the post mounts 60 for the rod 20. The clamp 18 is caused to move in the Y-direction along the rod 20 by a pinion gear 62 engaging an angled gear rack 64 attached to the rearward portion of each end collar such as 58. The angled gear rack 64 is biased against the pinion gear 62 by a contact-roller 65. The pinion gear 62 is driven by the motor 24 affixed to the frame 22 at a slant such as is shown in FIG. 1. It is hence to be appreciated that the entire clamp 18 moves in the Y-direction relative to the frame 22. The clamp 18 also moves relative to the supports 38, 40, 42 and 44.

Referring now to the upper portion 54 of the clamp, it is seen that the same houses a series of pneumatic actuators such as 66 and 68. Each actuator is attached to a common manifold 70 which receives pneumatic air pressure via a flexible tubing 72 having sufficient windings around a support 74 so as to accommodate a maximum movement of the clamp 18 in the Y-direction along the rod 20. Each pneumatic actuator includes an extendable end such as 76 for the actuator 66. The extendable end 76 moves downwardly within a cavity 78 so as to clamp the workpiece 16 against a bottom clamping surface 80. In this manner, the workpiece 16 is preferably clamped between spaced extendable ends of a plurality of pneumatic actuators. The spacing between pneumatic actuators is preferably two and three quarter inches so as to provide a distributed clamping of the workpiece 16.

It is to be noted that the bottom clamping surface 80 is coplanar with the top surfaces of the respective supports 38, 40, 42 and 44 so as to define a uniform, non-varying support to the underside of the workpiece. This is facilitated by the screw mounted attachment of the bottom clamping portion 56 which allows for minor corrections in the height of the surface 80 relative to the surface 50.

From the foregoing, it is to be appreciated that a positioning apparatus has been disclosed for positioning a relatively large and potentially flexible workpiece relative to a reciprocating operative tool. The workpiece is easily attached to the positioning apparatus via an air actuated clamping mechanism and substantially supported during movement underneath the reciprocating operative tool. It is to be understood that alternative apparatus may be substituted for elements of the preferred embodiment without departing from the scope of the present invention.

What is claimed is:

1. In a machine having an operative tool which performs one or more operations on a workpiece positioned on a planar bed underneath the operative tool, a positioning apparatus for positioning the workpiece on the planar bed said positioning apparatus comprising:

a movable frame mounted for movement in a first direction relative to the planar bed, said frame having a plurality of cantilevered supports, each cantilevered support being spaced with respect to an adjacent cantilevered support so as to define a plurality of spaced cantilevered supports which support the workpiece substantially along the entire length of the workpiece, each support extending outwardly from said frame in the first direction into slidable engagement with the planar bed whereby each support moves relative to said planar bed as said frame moves in the first direction; and means for holding the workpiece to be operated on by said operative tool, said holding means being mounted for movement on said frame in a second direction which is transverse to the first direction of movement, whereby the workpiece is moved in the second direction relative to said plurality of cantilevered supports and said planar bed as it is being supported on said plurality of cantilevered supports during movement in the first direction.

2. The machine of claim 1 wherein said planar bed comprises a plurality of grooved channels which receive said respective cantilevered supports extending from said frame.

3. The machine of claim 1 wherein the length of each cantilevered support extends outwardly in the first direction a substantial distance so as to support the entire width of the workpiece.

4. Apparatus for positioning a workpiece relative to an operative tool comprising:

a frame mounted for movement in a first direction;

a plurality of cantilevered supports fixedly attached to said frame, and extending outwardly from said frame in the first direction, said cantilevered supports being relatively spaced from each other so as to support the workpiece substantially along the entire length of the work;

a bed located underneath said operative tool, said bed having a plurality of grooved channels located therein for receiving the cantilevered supports extending outwardly from said frame whereby each cantilevered supports moves in the first direction of movement toward or away from the operative tool within a respective channel.

5. The apparatus of claim 4 further comprising:

means for holding the workpiece to be operated on by said operative tool, said holding means being mounted for movement on said frame in a second direction which is transverse to the first direction of movement of said frame, whereby the held workpiece is moved in the second direction relative to said plurality of cantilevered supports extending outwardly from said frame.

6. The apparatus of claim 5 wherein said means for holding the workpiece comprises:

means for clamping the workpiece so that the underside of the workpiece is maintained in a plane of support defined by said plurality of cantilevered supports, extending outwardly from said frame, for supporting the workpiece.

7. The apparatus of claim 6 wherein said means for clamping the workpiece comprises:

a bottom clamping member having a clamping surface coplanar with the plane of support defined by said plurality of cantilevered supports, extending outwardly from said frame, for supporting the workpiece; and a plurality of spaced pneumatic actuators which apply distributed pressure to the top of the workpiece so as to hold the workpiece against the bottom member.

8. The apparatus of claim 4 wherein each cantilevered support is beveled so as to define angular side and front surfaces relative to a top-surface of each support member.

9. The apparatus of claim 8 wherein the edges of the bed which encounter a moving workpiece are each beveled.

10. The apparatus of claim 4 wherein the top surface of each cantilevered support defines a common support plane for the workpiece.

* * * * *